US005267427A

United States Patent [19]

Peterson et al.

[11] Patent Number: 5,267,427

[45] Date of Patent: Dec. 7, 1993

[54] RECYCLING STRIP AND DISPENSER FOR HANDLING EMPTY PLASTIC BOTTLES

[76] Inventors: Kevin R. Peterson; Joan B. Peterson, both of 9 Churchill St., Sudbury, Mass. 01776

[21] Appl. No.: 831,563

[22] Filed: Feb. 5, 1992

[51] Int. Cl.[5] ..... B65B 27/04; B65B 21/08; B65B 41/12; B65B 67/00

[52] U.S. Cl. ..... 53/398; 53/48.1; 53/48.4; 53/591; 53/390

[58] Field of Search ..... 53/398, 48.1, 48.3, 53/48.4, 441, 556, 390, 591

[56] References Cited

U.S. PATENT DOCUMENTS

| | | | |
|---|---|---|---|
| 3,046,711 | 7/1962 | Harrison | 53/398 |
| 3,094,210 | 6/1963 | Van Den Berg | 53/48.1 X |
| 3,137,109 | 6/1964 | Rapata | 53/48.1 X |
| 3,302,364 | 2/1967 | Rice | 53/48.1 X |
| 3,383,827 | 5/1968 | Schaich | 53/398 |
| 4,121,401 | 10/1978 | Duerr et al. | 53/398 |

*Primary Examiner*—Horace M. Culver

[57] ABSTRACT

A recycling strip for holding, storing, toting, and returning empty recyclable plastic bottles, for instance, soft drink bottles. The strip has a plurality of collar holes distributed uniformly and unilinearly along the strip. The collar holes have a diameter sligthly larger than the outside diameter of a common plastic bottleneck. The collar holes have radial slits forming collars which enable a bottleneck flange to be engaged in the strip. The strip is then used for transporting engaged bottles and can be recycled with the bottles. The strip may be loaded in a dispenser which provides a convenient means of storing the strip. The dispenser also holds the strip securely so that a bottle may be engaged in the strip with a single one handed motion. Furthermore the dispenser provides an engagement mechanism, which aligns a collar hole in the strip with the collar openning of the dispenser and prevents the strip from uncontrolled travel out of the dispenser. It also provides a disengagement mechanism which meters the travel of the strip and is activated by a bottle engaged in the strip through the dispenser. The trailing portion of the strip with bottles engaged may then be removed from the dispenser for recycling.

9 Claims, 4 Drawing Sheets

RECYCLING STRIP AND DISPENSER FOR HANDLING EMPTY PLASTIC BOTTLES

FIELD OF THE INVENTION

This invention relates to the storage, transport, and return of empty recyclable and/or refundable plastic bottles, for example, plastic soft drink bottles.

BACKGROUND OF THE INVENTION

Many consumer fluids such as soft drinks are sold in plastic bottles. Most of these bottles are made of a recyclable plastic, such as, Type 1 PET (PolyEthylene Terephthalate). As a result these bottles are recylable and in some states they are refundable. For the purpose of the discussion the term, "bottle," refers to any such recyclable or refundable plastic bottles. The top of such bottles have a narrow threaded "bottleneck" for a twist off cap and a wider pertruding region at the neck base herein refered to as the "bottleneck flange."

It is a common and encouraged practice to recycle plastic bottles. This practice requires sorting, storage, and transport of the bottles. There are two primary channels for recycling bottles, recycling centers and curbside pickup. When returning bottles to a recycling center, the consumer is required to carry the bottles from the home to the center. This typically requires use of an automobile or similar mode of transportation. When using curbside pickup for recycling bottles, the consumer is typically required to sort recyclables and then carry them to the curb where a recycling agent will pickup the bottles. In some cases the recycling agent is required to sort the recyclables.

In some states it is standard practice to return bottles to the vendor or a redemption center for a cash refund. This practice also requires sorting, storage, and transport of the bottles. In particular, many redemption centers have to carefully sort bottles according to product or manufacturer. Additionally, redemption centers must count the number of bottles which the consumer returns to compute the amount of refund.

An unfortunate characteristic of the bottles is that they typically occupy a large volume, which places certain constraints on their handling Additionally, empty bottles are very light-weight and slippery. As a result, it is extremely difficult handling several bottles at one time.

The most common method for handling bottles is using a larger holding container. Large plastic garbage bags or large bins are frequently used. However these mechanisms are typically cumbersome, since such containers require much floor space themselves, are awkward to carry, are difficult to transport in most automobiles, and do not hold many bottles. Another problem with recycling containers is that they do not tend to keep the bottles upright and any residue in the bottles can leak into the container. Also, the container itself requires additional transport once the bottles have been disposed of.

OBJECTS AND ADVANTAGES

Accordingly, an object of the present invention is that it aids and improves all aspects of handling of recyclable bottles. The primary advantage of this invention is that it permits vertical storage of bottles. With this recycling strip bottles may be hung from a hook on a wall or a door, the hanger hook in an automobile, or a utility hook on a garbage can. This is advantageous since it reduces the need for floor space, which is typically taken up with containers for other recyclables such as newspaper, glass jars, aluminum cans, et al. This is especially important for storage and transport of bottles, since they take up a relatively large volume compared to that of other recyclables.

An additional benefit is that carrying the bottles is facilitated by the strip. A large number of bottles can be easily toted with the strip using a single hand. Most containers require two hands and much clearance.

Another benefit of this invention is that the neck of the bottle is held upright preventing residue in the bottle from spilling out. This feature is particularly important when transporting the bottles, since it prevents spills in and out of the home or in an automobile.

A further benefit of the strip is that it is small, lightweight, inexpensive, requires little material, and can be made of a recycled plastic compatible with the bottles to be recycled. For instance, a strip made from Type 1 PET plastic may be recycled with bottles of that type. In the latter case, the strip binds the compatible type bottles through all steps of the return cycle, simplifying the sorting task of the recycling agent. Alternatively, the strip may be reused. The consumer can easily pull the bottles out of the strip at the recycling center and retain the strip for future use.

The dispenser of the present invention provides a simple mechanism which holds the strip in place while bottles are inserted in the strip. The dispenser can be mounted at a convenient height on any vertical surface, for instance, on a door or wall. With the dispenser mounted little effort is required to push a bottle into the strip and then advance the strip to its next position.

DRAWING FIGURES

In the drawings FIG. 1 shows a possible embodiment of the present invention. FIGS. 2 and 3 show two different components of the preferred embodiment of the present invention. FIGS. 4, 5, and 6 show the operation of the preferred embodiment.

GENERAL DESCRIPTION

Figure 1:
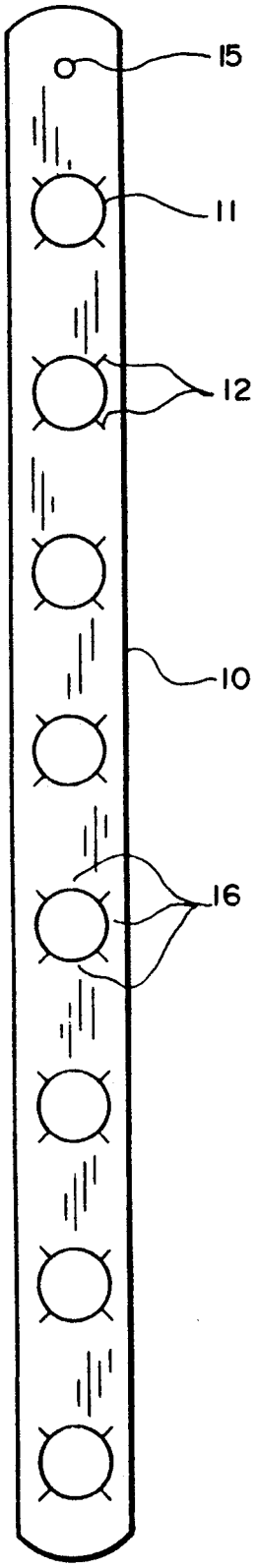
FIG. 1 is a frontal view of a fixed length recycling strip.

In its simplest form the recycling strip 10 shown in FIG. 1 is a fixed length and has a fixed number of collar holes 11. The recycling strip 10 can be made of a pliable plastic compatable with the plastic bottles 40.

Each collar hole 11 has a diameter sligthly larger than the outside diameter of the bottleneck 41 and slightly smaller than the bottleneck flange 42. Each collar hole 11 also has several slits 12 cut radially and evenly distributed around the hole. These slits 12 define equally as many regions of the strip around the collar hole 11 refered to as collars 16. The length of each slit 12 should be such that the diameter of the circle formed by the outermost endpoints of the slits is greater than the diameter of the bottleneck flange 42. This will permit the collars 16 surrounding a collar hole 11 to bend back as the bottleneck flange 42 is inserted.

The number of collar holes 11 may vary, however, providing a multiple of ten is convenient when returning bottles 40 for refund. The recycling strip 10 can have a smaller hanger hole 15 used to suspend it. However, this is not a necessity since the upper most collar hole 11 can be used for the same purpose.

Figure 2:
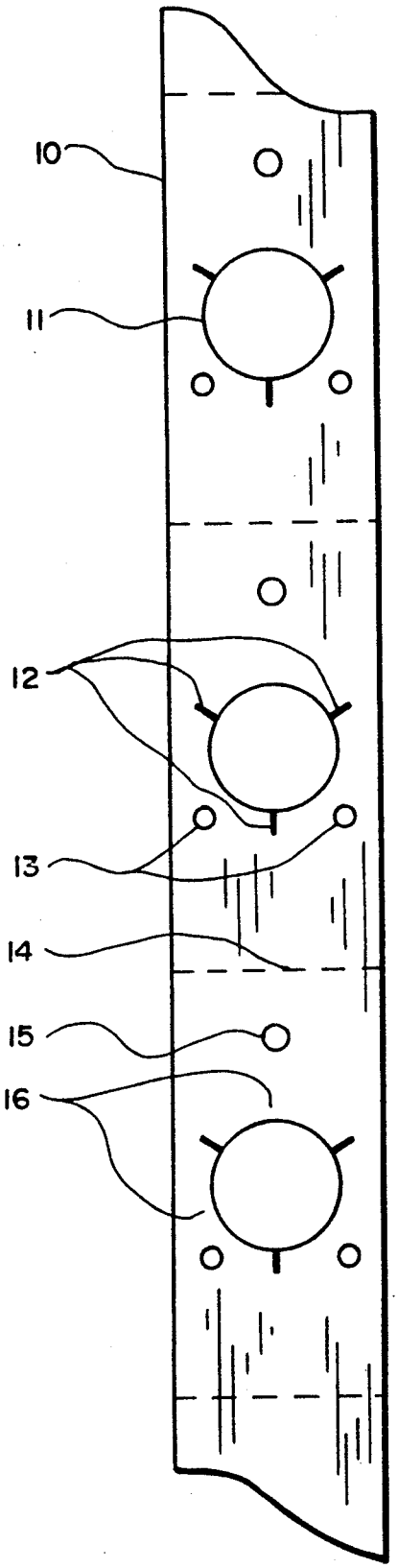
FIG. 2 is a frontal view of a variable length recycling strip.

In the preferred embodiment shown in FIG. 2 the recycling strip 10 is similar to that in FIG. 1. However, it is has extra features which make it amenable to dispensing. In addition to the collar holes 11 and slits 12, the recycling strip 10 has alignment holes 13 and perferations 14. The alignment holes 13 are placed around the collar holes 11. The perferations 14 are made across the strip 10 between collar holes 11. In this preferred embodiment the recycling strip 10 is made of the same type of plastic as the bottles 40 which it supports, since this compatibility facilitates disposal of both the bottles 40 and the strip 10 which binds them.

Figure 3:
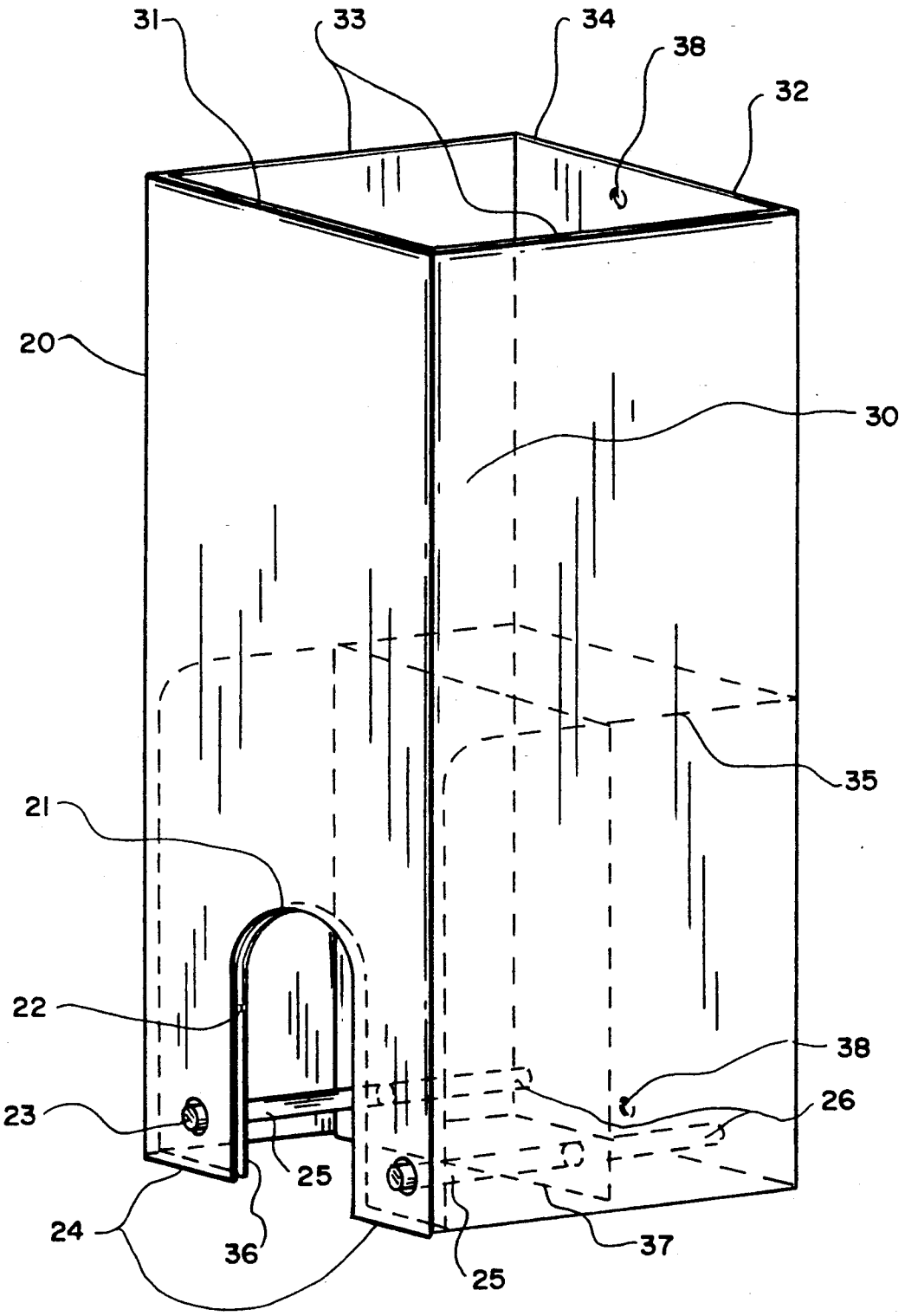
FIG. 3 is an isometric view of a recycling strip dispenser.

FIG. 3 shows the recycling strip dispenser 20. In the prefered embodiment the dispenser 20 is a rectangular parallel-piped, in other words, a box. The dispenser has a front wall 31, a back wall 32, two side walls 33, and optionally a top 34. It is open at the bottom. The upper half of the dispenser forms a chamber 30. A mid-wall 35 which is perpendicular to the front wall 31, back wall 32, and side walls 33 forms the floor of the chamber 30. The mid-wall 35 is attached to all but the front wall 31 and it folds into the channel wall 36 which runs parallel to the front wall 31 of dispenser. The front wall 31 and the channel wall 36 form the strip channel 22 and both have overlaying arch-shaped collar openning 21 and set of alignment holes 23. At the bottom of the arch legs of the front wall 31 is a cutting edge 24. Attached only to the mid-wall 35 is the disengagement plate 37 which runs parallel to and between the channel wall 36 and back wall 32. The disengagement plate 37 is free of the side walls 33 allowing it to bend from its joint at the mid-wall 35. The disengagement plate 37 has a set of alignment pins 25, which in its quiescent state pertrude forward through the aligment holes 23 in both the channel wall 36 and the front wall 31. The stop pins 26 pertrude back from the engagement plate 37 toward the back wall 32. The dispenser 20 has mounting holes 38 in the back wall 32.

Figures 4, 5:
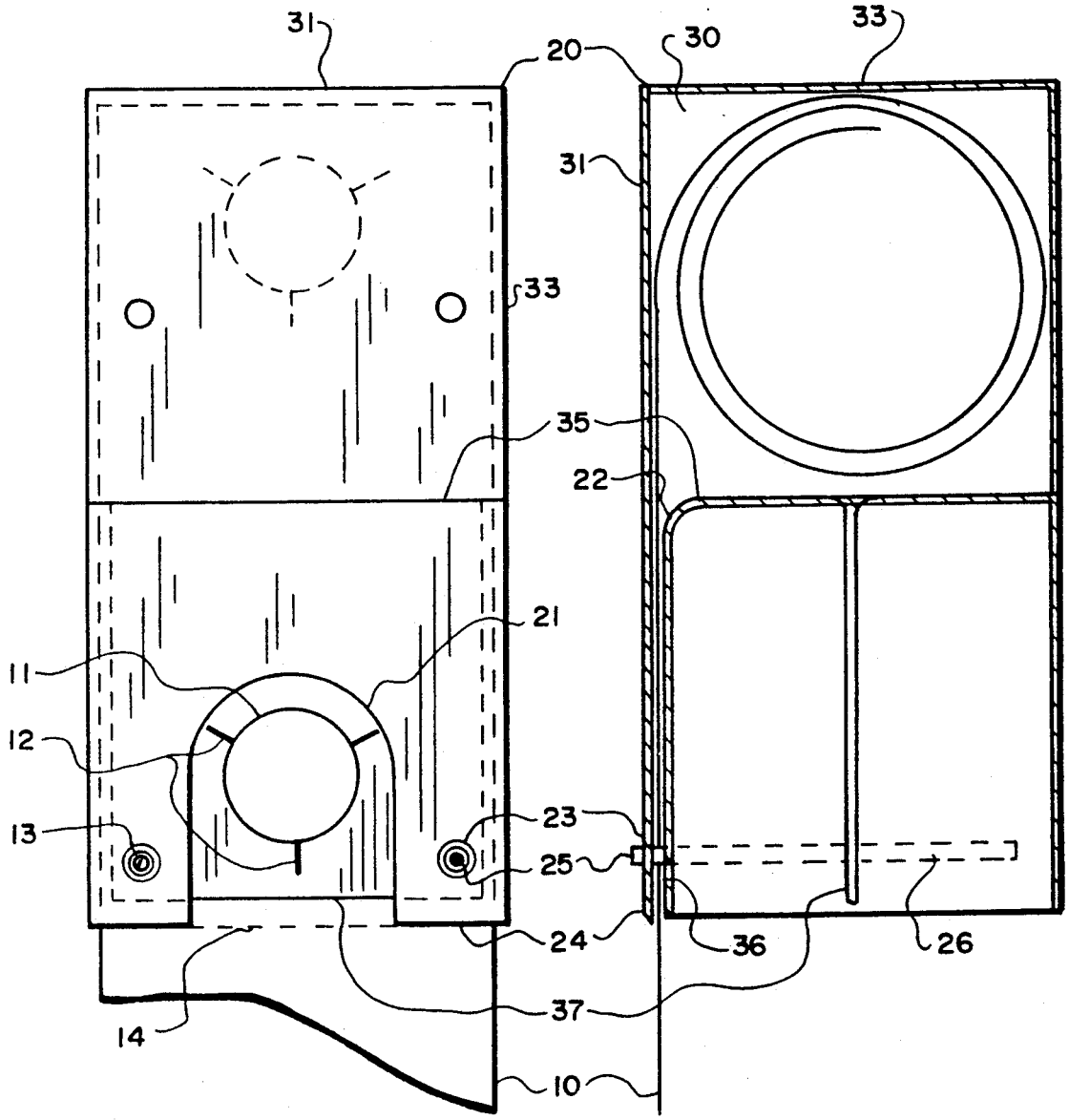
FIG. 4 is a frontal view of a recycling strip and dispenser showing the recycling strip feeding through the dispenser
FIG. 5 is a side cross-sectional view of a recycling strip and dispenser showing the recycling strip feeding through the dispenser.

In the frontal view of FIG. 4 the recycling strip 10 is shown fed through the dispenser 20. In this view the close relationship between the features of the recycling strip 10 and the dispenser 20 can clearly be seen. The alignment holes 13 of the strip 10 are positioned so they are concentric with the aligment holes 23 of the dispenser 20. Furthermore, the alignment pins 25 are seen through the recycling strip alignment holes 13 and the dispenser alignment holes 23. In this position the collar holes 11 of the strip 10 are also concentric to the arch-shaped collar openning 21 of the dispenser 20. The diameter of the arch is spanned by the outer most points of the slits 12, hence is sligthly larger than the bottleneck flange 42. The perferations 14 in the strip 10 align with the cutting edge 24 at the bottom of the front wall 21 of the dispenser 20.

In the side view of FIG. 5 a rolled recycling strip 10 is shown in the chamber 30 of the dispenser 20. The remainder of recycling strip 10 is positioned in the strip channel 22 and exits the bottom of the dispenser 20. Here the alignment pins 25 can be seen passing through the alignment holes 23 in the channel wall 36 and front wall 31 and engaging the recycling strip 10 alignment holes 13. The distance between the channel wall 36 and disengagement plate 37 should be equal to the distance between the top of a bottle 40 and the bottleneck flange 42. The dispenser 20 has a sharp cutting edge 24 at the bottom of the front wall 31.

Figure 6:
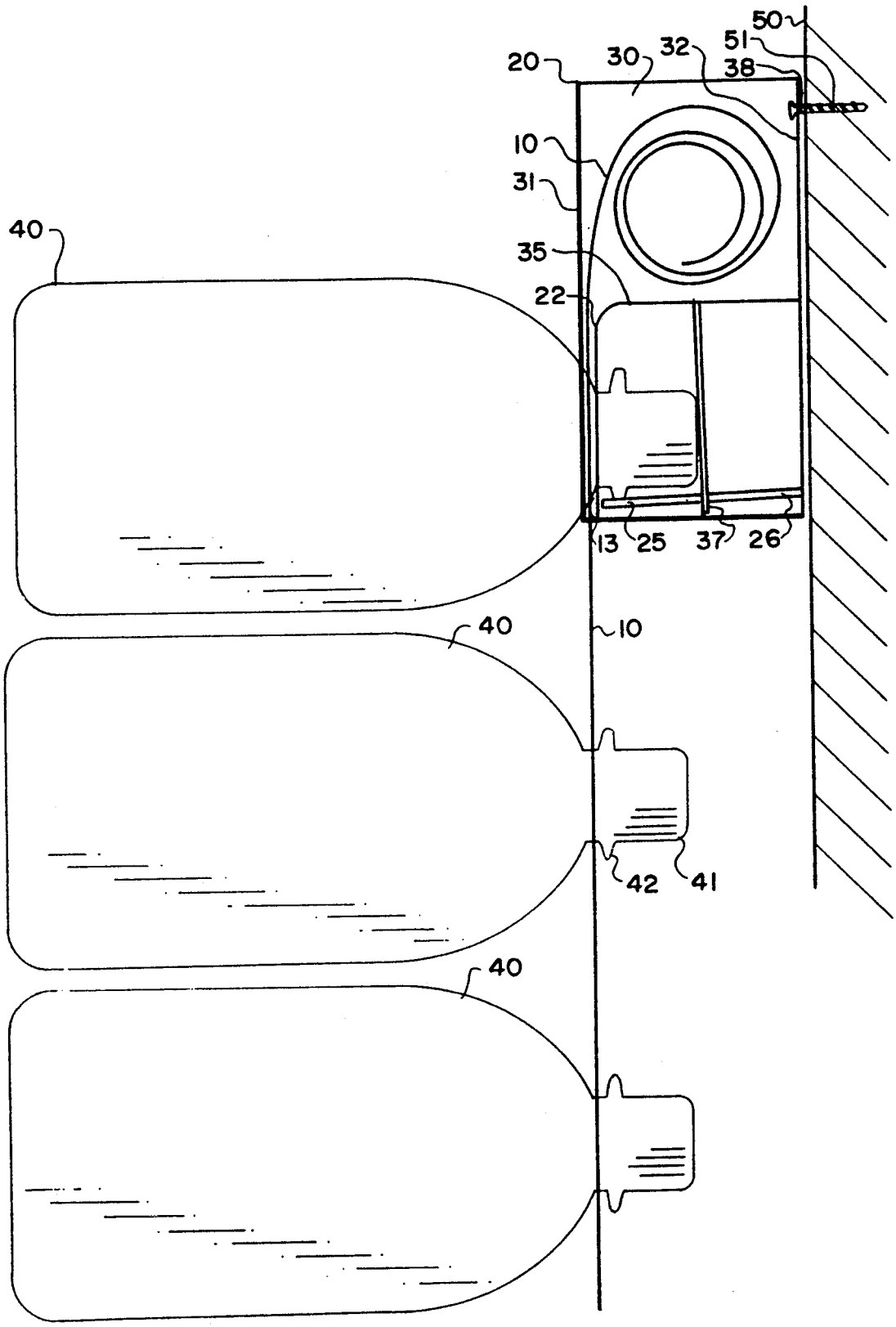
FIG. 6 is a side cross-sectional view of a recycling strip and dispenser showing the recycling strip feeding through the dispenser and a plurality of bottles engaged in the strip.

FIG. 6 is another side view showing the dispenser 20 mounted to a vertical surface 50 such as a door or a wall. The dispenser 20 provides mounting holes 38 for attachment to a vertical surface 50 with screws 51 or other fasteners. A rolled recycling strip 10 is shown in the chamber 30 of the dispenser 20. Here bottles 40 are shown engaged in the recycling strip 10. The uppermost bottleneck flange 42 has passed through the collar hole 11 and collar openning 21. The uppermost bottle 40 has driven the disengagement plate 37, such that the aligment pins 25 have disengaged from the alignment holes 13. The stop pins 26 have prevented the disengagement plate 37 from excessive travel and potential damage. The tail end of recycling strip 10 exits the bottom of the dispenser 20 and has a plurality of bottles 40 previously engaged.

In any embodiment the recycling strip can be made by plastic extrusion. As the strip is extruded the collar holes 11, slits 12, alignment holes 13, perferations 14, and hanger hole 15 may be periodically punched with appropriate tools. The extruded strip can be rolled on to reels or cut to an appropriate length. Although the composition and dimensions of the strip and position of the holes and cuts may vary, the purpose of corresponding parts of the invention is identical across implementations.

Nevertheless, there are several desirable attributes of the strip. The recycling strip can be made:

- from recycled plastic, for instance Type 1 PET, and can itself be recycled.
- thin enough to be light, inexpensive, and represent a small volume (typically less than 1%) of the total recycled plastic.
- flexible enough to permit the bottleneck flange 42 to fold back the collars 16 around the collar holes 11.
- supple enough to permit the collars 16 to spring back around the bottleneck 41.
- strong enough to support a plurality of bottles 40 and not easily break or tear.
- with perferations 14 which permit a portion of the strip 10 to be detached with ease.

In the preferred embodiment the dispenser can be made by plastic injection molding. Although a single injection mold may be possible, it is envisioned that the dispenser could be assembled from a small number of parts which have been injection molded.

There are also several desirable attributes of the dispenser. The dispenser:

- can be made inexpensively, preferrably from recycled plastic.
- can be made large enough to hold a rolled recycling strip.
- front wall can be made sturdy enough to sustain numerous insertions.
- disengagement plate can be made resilient enough to return retaining pins after numerous insertions.

alignment pins can be made strong enough to sustain the downward force of the strip.

The present invention has been shown in several embodiments including a preferred embodiment However, modifications and variations can be made within the spirit of the invention. The present invention, therefore, is not intended to be limited to any specific form or embodiment except as such limitations are expressed in the claims. A multiple strip dispenser is also invisioned simplifying the sorting of bottles by vender or color. Furthermore, it is possible to use this invention for purposes other than the handling of plastic bottles 40. The invention can also be used for the handling of any light-weight objects which will fit in the collar holes 11 in the strip 10.

NORMAL OPERATION

In both embodiments of the present invention shown in FIG. 1 and 2, the recycling strip 10 has a plurality of collar holes 11. Each collar hole 11 is sized to receive the bottleneck 41. The purpose of the radially extending slits 12 is to form the collars 16 which bend away from the bottleneck flange 42 as it is projected through the collar hole 11. Once the bottleneck flange 42 has pushed through the collar hole 11, the plastic around the collar hole 11 returns to its static position thus securing the plastic bottle 40. The strip 10 may then be suspended from a hook using the upper-most collar hole 11 or a smaller hanger hole 15 at the top of the strip. A plurality of bottles 40 may be engaged in the remaining collar holes 11 in the strip 10.

The recycling strip 10 in FIG. 1 has a fixed length and a fixed number of collar holes 11. This strip will permit up to the fixed maximum number of bottles 40 to be returned at one time.

The recycling strip 10 in FIG. 2 has a variable length, varying number of collar holes 11, and perferations 14 between adjacent collar holes 11. It may be rolled and dispensed similar to other products. For instance, paper towels are typically dispensed on a roll and are individually detached from the roll at the preferations which are spaced uniformily along the roll. The recycling strip will be unrolled as bottles 40 are inserted into its collar holes. However, the portion of the strip holding the bottles 40 need only be detached from the roll when it is convenient to return the bottles 40.

As shown in FIG. 3 the dispenser 20 has an upper chamber 30 for holding a rolled recycling strip 10.

The following paragraphs describe the operation of the preferred embodiment, the recycling strip 10 with dispenser 20, depicted in FIGS. 4, 5, and 6.

FIGS. 4 and 5 show a rolled recycling strip 10 loaded in the dispenser 20. The dispenser 20 may be filled by unrolling on end of the recycling strip 10 and beginning to feed it down through the strip channel 22. For initial insertion of the strip, the disengagement plate 37 must be pushed toward the back wall 32 of the dispenser until the stop pins 26 meet the back wall 32. In this position, the alignment pins 25 are free of the strip channel 22. The end of the recycling strip 10 may then be slid down until the alignment holes 13 on the strip line up with the aligment holes 23 of the dipenser 20. The disengagement plate 37 may then be released to engage the alignment pins 25 in the alignment holes 13 and 23 At this point the strip 10 and dispenser 20 are ready to accept bottles 40.

FIG. 6 shows the preferred embodiment in operation Normally the dispenser 20 is mounted to a vertical surface 50, such as a wall or door. The dispenser 20 is attached to a vertical surface 50 with screws 51 or other fasteners through the mounting holes 38.

With a strip 10 loaded in the dispenser 20, a bottle 40 may be engaged in the strip 10 by thrusting the bottleneck 41 through the collar hole 11. When the bottleneck 41 is pushed through the collar hole 11, it hits the disengagement plate 37. As the bottleneck flange 42 passes through the collar hole 11, the disengagement plate 37 pulls the alignment pins 25 out of the alignment holes 11. The strip 10 is then free to slide down with the bottle 40 engaged. Once the bottle 40 has slid down out of the dispenser 20, the engagement plate 37 springs back. The alignment pins 25 then press against the strip 10. The strip 10 proceeds to slide down, until alignment pins 25 engage the next set of alignment holes 11. Subsequent bottles 40 may be inserted in the strip 10 in the same manner.

At some point a sufficient number of bottles 40 will be engaged in the strip 10 to warrant return. The dangling portion of the strip 10 holding the bottles 40 may then be detached The dangling strip 10 is pulled up and out so that, the cutting edge 24 at the bottom the front wall 31 of the dispenser 20 severs the strip 10 at the perferations 14.

The hanger hole 15 may then be used to store, tote, or transport the detached strip 10 with bottles 40. If the strip 10 complete with a plurality of bottles 40 is dropped, they remain securely fastened. This is particulary important for curbside pickup where the recycling agent does not want to be burdened with picking up loose bottles 40 should a container spill.

The strip 10 and bottles 40 may then be returned to a recycling or redemption center and recycled. Optionally, the bottles 40 may be disengaged from the strip 10 and the strip 10 can be reused.

We claim:

1. A device for holding a recycling strip having a plurality of circular collar holes placed uniformly along the strip for the insertion of recyclable bottles having bottleneck flanges comprising:

(a) a strip dispenser having a vertically rectangular parallelepiped form with a front wall, a back wall, and side walls, each said wall having a top and a bottom which define a top and a bottom of said dispensing device;

(b) a chamber formed by said front wall, said back wall, said side walls, and a horizontal partial midwall for holding the recycling strip, said front wall defining a front of said chamber and said midwall defining a bottom of said chamber;

(c) a channel exiting the chamber bottom at the front of said chamber and formed by said front wall and a a parallel inner channel wall for threading the recycling strip;

(d) a collar opening at the bottom of aid front wall and said channel wall having a semicircular arch shape slightly wider than a bottleneck flange and permitting insertion of a bottleneck into a concentrically aligned collar hole of the threaded recycling strip in said channel;

(e) a mounting means for securing said strip dispenser to a vertical surface;

whereby said strip dispenser is used to facilitate the storage of recyclable bottles.

2. The invention of claim 1 further including a locking means which secures the recycling strip in place automatically, whenever a collar hole of the threaded recycling strip concentrically aligns with said collar opening.

3. The invention of claim 2 further including a disengagement means which releases said locking means automatically as a bottleneck is inserted in a collar hole of the threaded recycling strip permitting the strip to travel down said channel.

4. The invention of claim 3 further including a detachment means on the bottom of said strip dispenser facilitating the detachment of the exiting recycling strip with bottles.

5. A device for holding a plurality of recycling strips each having a plurality of circular collar holes placed uniformly along each strip for the insertion of recyclable bottles having bottleneck flanges comprising:

(a) a multi-strip dispenser having a vertically rectangular parallelepiped form with a front wall, a back wall, side walls, and a plurality of internal vertical walls parallel to said side walls forming a plurality of individual dispensers, said front wall, back wall and side walls defining a top and a bottom of said multi-strip dispenser;

(b) a chamber in each said individual dispenser formed by said front wall, said back wall, and side walls, said internal vertical walls, and a horizontal partial midwall for holding a recycling strip, said front wall defining a front of each chamber and said midwall defining a bottom of each chamber;

(c) a channel in each of said individual dispenser exiting the bottom of each chamber at the front of each of said chambers and formed by said front wall and a parallel inner channel wall for threading the recycling strip;

(d) a collar opening in each said individual dispenser at the bottom of said front wall and said channel wall having a semicircular arch shape slightly wider than a bottleneck flange and permitting insertion of a bottleneck into a concentrically aligned collar hole of the threaded recycling strip in said channel;

(e) a mounting means for securing said multi-strip dispenser to a vertical surface;

whereby said multi-strip dispenser is used to facilitate the storage and sorting of recyclable bottles.

6. The invention of claim 5 further including a locking means in each said individual dispenser which secures the recycling strip in place automatically, whenever a collar hole of the threaded recycling strip concentrically aligns with said collar opening.

7. The invention of claim 6 further including a disengagement means in each said individual dispenser which releases said locking means as a bottleneck is inserted in a collar hole of the threaded recycling strip permitting the strip to travel down said channel.

8. The invention of claim 7 further including a detachment means on the bottom of each said individual dispenser facilitating the detachment of the dangling recycling strip with bottles.

9. A method of holding and storing recyclable bottles having bottleneck flanges comprising:

(a) providing a flexible recycling strip having a plurality of circular collar holes placed uniformly along said strip;

(b) providing a strip dispenser having
a vertically rectangular parallelepiped form,
a chamber for holding said recycling strip,
a channel exiting said chamber for feeding said recycling strip,
a collar opening at the bottom of said channel slightly wider than said bottleneck flange,
a locking means which secures said recycling strip in said channel automatically revealing an aligned collar hole of said plurality of collar holes concentric with said collar opening,
a disengagement means which automatically releases said locking means whenever a bottleneck is inserted into said aligned collar hole freeing said recycling strip,
a detachment means for removal of an exiting portion of said recycling strip, and
a mounting means for securing said strip dispenser to a vertical surface;

(c) placing said recycling strip in said chamber;

(d) feeding said recycling strip in said channel until locking means secures said recycling strip in place;

(e) inserting a bottleneck into said aligned collar hole until the bottleneck flange securely engages said recycling strip and releases disengagement means;

(f) repeating steps (d) and (e) for additional bottles; and (g) removing said exiting portion of said recycling strip with said detachment means for return of recyclable bottles.

* * * * *